US008833903B2

(12) United States Patent
Sahara et al.

(10) Patent No.: US 8,833,903 B2
(45) Date of Patent: Sep. 16, 2014

(54) INKJET RECORDING APPARATUS AND METHOD

(75) Inventors: Akiyoshi Sahara, Funabashi (JP); Yasufumi Ogasawara, Tachikawa (JP); Takeaki Nakano, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 354 days.

(21) Appl. No.: 13/193,486

(22) Filed: Jul. 28, 2011

(65) Prior Publication Data

US 2012/0044290 A1 Feb. 23, 2012

(30) Foreign Application Priority Data

Aug. 18, 2010 (JP) ..... 2010-183046
Jul. 7, 2011 (JP) ..... 2011-150904

(51) Int. Cl.
*B41J 2/165* (2006.01)
*B41J 2/17* (2006.01)
*B41J 19/20* (2006.01)

(52) U.S. Cl.
CPC ..... *B41J 2/1721* (2013.01); *B41J 2/16526* (2013.01); *B41J 19/202* (2013.01)
USPC ..... 347/35

(58) Field of Classification Search
CPC .... B41J 19/202; B41J 2/16517; B41J 2/1652; B41J 2/16526
USPC ..... 347/35
See application file for complete search history.

(56) References Cited

U.S. PATENT DOCUMENTS

2006/0244792 A1* 11/2006 Tanaka ..... 347/85
2008/0218549 A1* 9/2008 Iriguchi ..... 347/14

FOREIGN PATENT DOCUMENTS

JP 7-025026 A 1/1995

* cited by examiner

*Primary Examiner* — Julian Huffman
(74) *Attorney, Agent, or Firm* — Canon USA, Inc., IP Division

(57) ABSTRACT

An inkjet recording apparatus may include a recording unit, an ink receiver, and a control unit. The recording unit records an image on a sheet by causing a recording head including a plurality of nozzle arrays to reciprocate along a surface of the sheet in a direction in which the plurality of nozzle arrays is arranged. The ink receiver receives ink ejected outside the sheet in preliminary ejection from the recording head. Depending on a recording region on the sheet and which of the plurality of nozzle arrays is or are to be used for recording, the control unit determines a reversing position at which the recording head is reversed in direction of the reciprocation such that all of the plurality of nozzle arrays pass over the ink receiver in a single scan included in the reciprocation.

8 Claims, 11 Drawing Sheets

INKJET RECORDING APPARATUS AND METHOD

BACKGROUND OF THE INVENTION

1. Field of the Invention

The present invention relates to an inkjet recording apparatus.

2. Description of the Related Art

Japanese Patent Laid-Open No. 7-025026 discloses an inkjet recording apparatus capable of performing preliminary ejection to prevent poor ink ejection. The inkjet recording apparatus moves a recording head to a non-recording region outside a sheet to perform preliminary ejection onto an ink receiver. This can reduce clogging in the recording head and occurrence of poor ink ejection.

To improve printing throughput, it is preferable that both recording on a sheet and preliminary ejection be performed in the same scan of the recording head that reciprocates for image recording. In scanning of the recording head, it is desirable to minimize the moving distance of the recording head by determining the reversing position for reversing the head scanning direction in accordance with a recording region of the sheet.

However, depending on the recording region on the sheet and which of a plurality of nozzle arrays of the recording head is or are to be used for recording, some of the nozzle arrays may not be able to reach a position above the ink receiver during reciprocation. Preliminary ejection from nozzle arrays that fail to reach the position above the ink receiver cannot be performed. This leads to poor ink ejection and degradation in image quality.

SUMMARY OF THE INVENTION

The present invention provides a technique with which preliminary ejection from all nozzle arrays can be reliably performed during reciprocation of the recording head for recording.

According to an aspect of the present invention, an inkjet recording apparatus includes: a recording unit configured to record an image on a sheet by causing a recording head including a plurality of nozzle arrays to reciprocate along a surface of the sheet in a direction in which the plurality of nozzle arrays is arranged; an ink receiver configured to receive ink ejected outside the sheet in preliminary ejection from the recording head; and a control unit, wherein, depending on a recording region on the sheet and which of the plurality of nozzle arrays is or are to be used for recording, the control unit determines a reversing position at which the recording head is reversed in direction of the reciprocation such that all of the plurality of nozzle arrays pass over the ink receiver in a single scan included in the reciprocation.

In the present invention, regardless of the recording region on the sheet and which of the plurality of nozzle arrays is or are to be used for recording, preliminary ejection from all the nozzle arrays can be reliably performed during reciprocation of the recording head for recording. It is thus possible not only to improve printing throughput, but also to prevent degradation in image quality.

Further features of the present invention will become apparent from the following description of exemplary embodiments with reference to the attached drawings.

DESCRIPTION OF THE EMBODIMENTS

Figure 1:
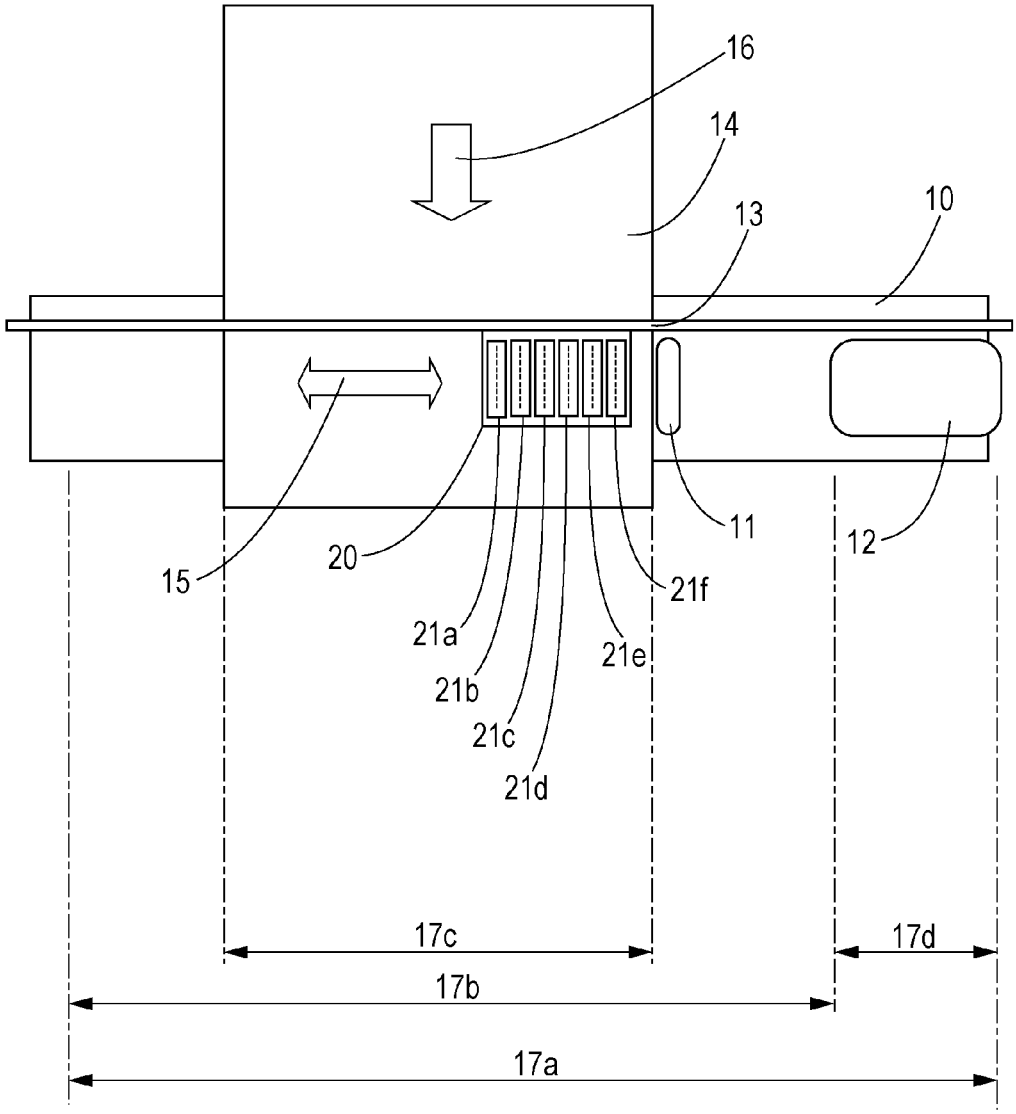
FIG. 1 illustrates a configuration of a recording unit of an inkjet recording apparatus according to an embodiment.

FIG. 1 illustrates a configuration of a recording unit of an inkjet recording apparatus. Specifically, FIG. 1 schematically illustrates positional relationships among components within a range of reciprocation of a recording head 20. The recording head 20 is an inkjet recording head including a plurality of nozzle arrays 21 (nozzle arrays 21*a*, 21*b*, 21*c*, 21*d*, 21*e*, and 21*f* for six colors) from which ink is ejected in an inkjet method. The nozzle arrays 21*a* to 21*f* are arranged in a direction of arrow 15. The recording head 20 is mounted on a carriage, which reciprocates (or bidirectionally scans) in the direction of arrow 15. A guide 13 is configured to guide the movement of the carriage. The recording head 20 ejects ink onto a sheet (recording medium) 14 while moving, and thereby records (prints) a single band of an image on the sheet 14. The sheet 14 is fed in a direction of arrow 16 stepwise on a band-by-band basis (sub-scanning). As the recording head 20 reciprocates in the direction of arrow 15 (main scanning), an image is formed on the sheet 14 in a serial printing method.

A platen 10 is disposed in a region (indicated by 17*a* in FIG. 1) which includes a maximum region (indicated by 17*b* in FIG. 1) where the recording head 20 is caused to reciprocate by the carriage during image recording. The sheet 14 that moves in the sub-scanning operation is held on a support surface of the platen 10. In the example of FIG. 1, the sheet 14 has a sheet width indicated by 17*c*. An ink receiver 11 (ink-droplet collecting unit) is embedded in the support surface of the platen 10. The ink receiver 11 is disposed within the scanning region of the recording head 20 and is located near the region corresponding to 17*c*. While the recording head 20 is being moved, preliminary ejection from ink nozzles of a nozzle array toward the ink receiver 11 is performed when the nozzle array passes over the ink receiver 11. The preliminary ejection involves ejection of several ink droplets (e.g., five ink droplets) from each nozzle. During reciprocation of the recording head 20, both printing and preliminary ejection can be performed in a single scan.

In the direction in which the recording head 20 moves, an ink receiver 12 larger than the ink receiver 11 is disposed outside the ink receiver 11 and near a home position (initial position). The ink receiver 12 has a size (indicated by 17*d* in FIG. 1) that can accommodate all the plurality of nozzle arrays 21*a* to 21*f*. When the recording head 20 is located above the ink receiver 12, preliminary ejection from all the nozzle arrays 21*a* to 21*f* can be performed at substantially the same time.

During a recording operation, it is possible to move the recording head 20 to the ink receiver 12 for preliminary ejection. However, if the recording head 20 is frequently moved to the ink receiver 12, the time required for the movement may cause degradation in printing throughput. Therefore, it is preferable to perform preliminary ejection onto the ink receiver 11, not onto the ink receiver 12, as much as possible.

Figure 2:
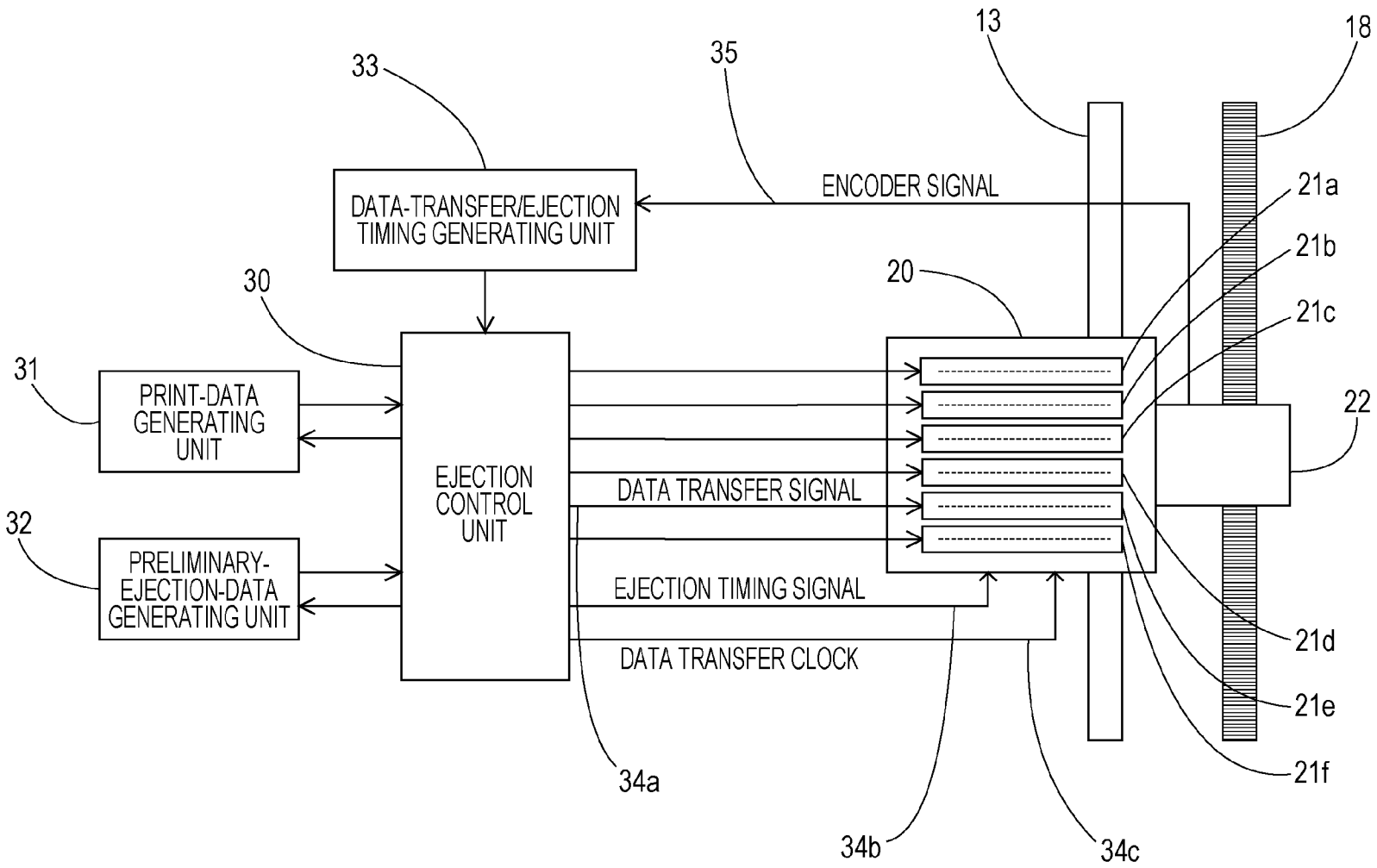
FIG. 2 is a block diagram illustrating a system configuration of a control unit and components therearound.

FIG. 2 is a block diagram illustrating a system configuration of a control unit and components therearound in the inkjet recording apparatus. The plurality of nozzle arrays 21*a* to 21*f* included in the recording head 20 are connected to an ejection control unit 30 through independent data transfer signal lines 34*a*, an ejection timing signal line 34*b* common to the nozzle arrays 21*a* to 21*f*, and a data transfer clock line 34*c* common to the nozzle arrays 21*a* to 21*f*. The ejection control unit 30 is connected to a print-data generating unit 31, a preliminary-ejection-data generating unit 32, and a data-transfer/ejection timing generating unit 33.

An encoder sensor 22 is attached to the carriage together with the recording head 20. The encoder sensor 22 optically reads a code on a code strip 18 attached in parallel with the guide 13. The read code is transmitted as an encoder signal to an encoder signal line 35, and is further transmitted as positional information of the recording head 20 to the data-transfer/ejection timing generating unit 33. On the basis of the encoder signal, the data-transfer/ejection timing generating unit 33 generates timing of data transfer to the recording head 20 and timing of ejection from the recording head 20. The ejection control unit 30 integrates the resulting print data (recording data) and preliminary ejection data and transfers the resulting data to each nozzle array. Additionally, the ejection control unit 30 controls data transfer and ejection timing on the basis of the encoder signal. This allows printing and preliminary ejection from a plurality of nozzle arrays to be performed in parallel.

Figure 3A:
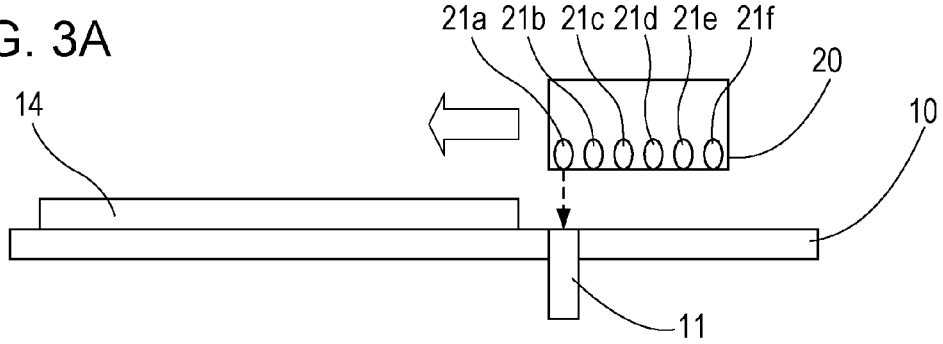
FIG. 3A to FIG. 3D illustrate a process in which preliminary ejection onto an ink receiver is performed in parallel with printing.

FIG. 3A to FIG. 3D schematically illustrate a procedure in which printing and preliminary ejection onto the ink receiver 11 are performed in parallel in a single scan of the recording head 20. The recording head 20 starts scanning toward the sheet 14 (in the direction of hollow arrow) at a scanning start position (or a stop position in reciprocation) near the home position. FIG. 3A illustrates a moment when the leading nozzle array 21*a* at the left end in the scanning direction has reached a position directly above the ink receiver 11. In response to this, preliminary ejection from the nozzle array 21*a* onto the ink receiver 11 starts. Preliminary ejection from the other nozzle arrays 21*b* to 21*f*, which have not yet reached the position above the ink receiver 11, does not start at this point. Preliminary ejection from the nozzle array 21*b* starts when the nozzle array 21*b* has reached the position directly above the ink receiver 11. The preliminary ejection from the nozzle array 21*a* has been completed at this point.

Figure 3B:
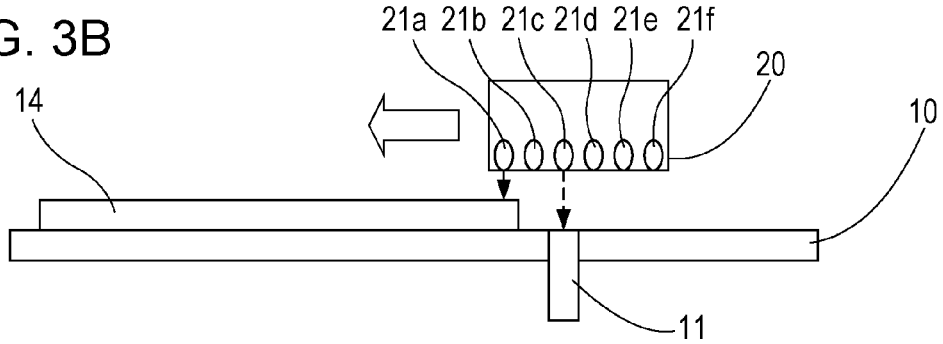

In the state of FIG. 3B, the nozzle array 21*c* is located above the ink receiver 11, and the leading nozzle array 21*a* is located at an end of a recording region of the sheet 14 adjacent to the home position. At this point, preliminary ejection from the third nozzle array 21*c* is performed and ink is ejected from the nozzle array 21*a* toward the sheet 14 for recording. That is, recording with a preceding nozzle array and preliminary ejection from a succeeding nozzle array are performed in parallel. In the present specification, the term "in parallel" means not only that ink ejection for recording and preliminary ejection from other nozzles take place substantially simultaneously (i.e., at exactly the same time, or at substantially the same time with a slight time difference as well as an overlap in time), but also that they are performed sequentially in a short time with no overlap in time.

Figure 3C:
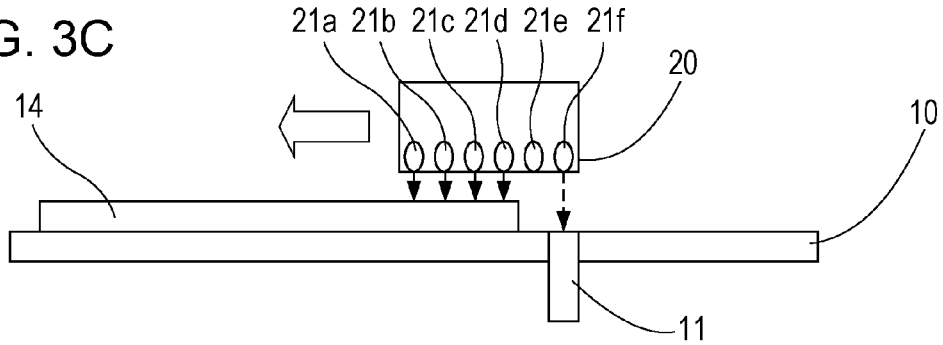
Figure 3D:
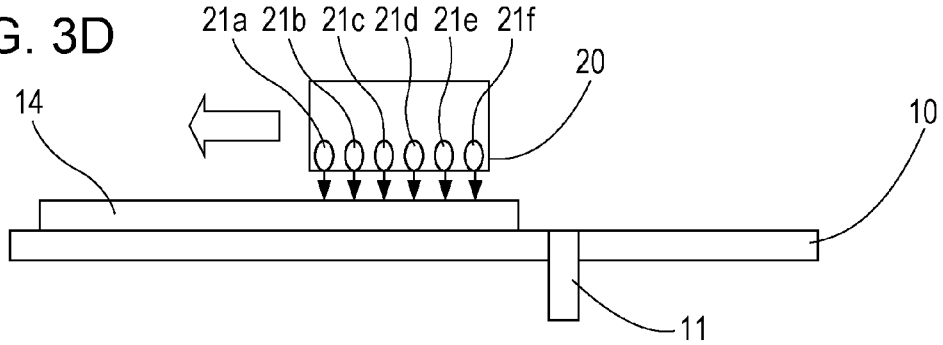

Likewise, in parallel with preliminary ejection from each of the nozzle arrays 21*d*, 21*e*, and 21*f* (in this order) onto the ink receiver 11, ink ejection for printing from the preceding nozzle arrays that have reached the recording region of the sheet 14 is performed. In the state of FIG. 3C, preliminary ejection from the trailing nozzle array 21*f* is performed in parallel with printing using the preceding nozzle arrays 21*a* to 21*d*. In the state of FIG. 3D, all the nozzle arrays 21*a* to 21*f* that have completed the preliminary ejection are located above the sheet 14. While the recording head 20 is scanning over a range which covers the recording region of the sheet 14, a single band of printing is completed using all the nozzle arrays 21*a* to 21*f*. When the recording head 20 reaches the reversing position in the reciprocation, the moving direction of the recording head 20 is reversed. After a single band of sub-scanning, the recording head 20 returns to the scanning start position. In the same manner, the reciprocation is repeated to form an image.

Figure 4A:
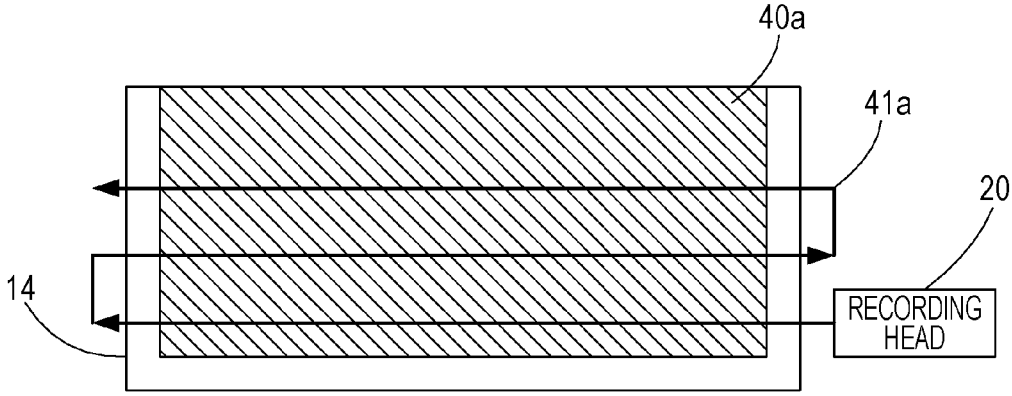
FIG. 4A and FIG. 4B illustrate how a range of reciprocation changes depending on a recording region on a sheet.
Figure 4B:
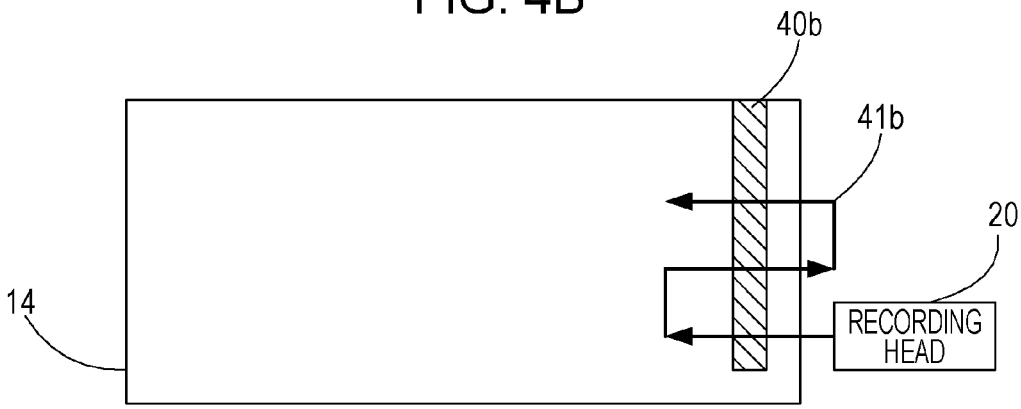

FIG. 4A and FIG. 4B schematically illustrate how a range of reciprocation of the recording head 20 (i.e., the reversing position in scanning) changes depending on a recording region on the sheet 14. Reference numerals 40*a* and 40*b* each denote a recording region where recording is performed by printing on the sheet 14. Reference numerals 41*a* and 41*b* each denote a locus along which the recording head 20 scans over the sheet 14 (i.e., a two-dimensional locus of main scanning and sub-scanning over the surface of the sheet 14). As illustrated in FIG. 4A, if the recording region 40*a* that occupies a large area of the sheet 14 is set as a recording region, the recording head 20 reciprocates with a long stroke and the locus 41*a* of the recording head 20 passes through both ends of the sheet 14 in the sheet width direction.

On the other hand, as illustrated in FIG. 4B, if the recording region 40*b* which is narrow and is located near the end of the sheet 14 adjacent to the home position is set as a recording region, the recording head 20 reciprocates with a short stroke and the locus 41*b* of the recording head 20 passes through only the end of the sheet 14 adjacent to the home position. Thus, in accordance with the size and location of the recording region, the most appropriate reversing position in reciprocation of the recording head 20 is determined. The reversing position mentioned here is a reversing position remote from the home position or the ink receiver 11. A reversing position (scanning start position) adjacent to the home position is fixed throughout repeated reciprocation of the recording head 20. Thus, by determining the stroke of reciprocation depending on the setting of the recording region, it is possible to reduce the time required for recording, that is, to improve printing throughput.

As in the case of the recording region 40*b* illustrated in FIG. 4B, if the recording region is a small area on one side adjacent to the home position, and hence the stroke of the recording head 20 is short in the sheet width direction, there may be an occurrence of the following phenomenon, which is to be addressed in the present embodiment.

Figure 5A:
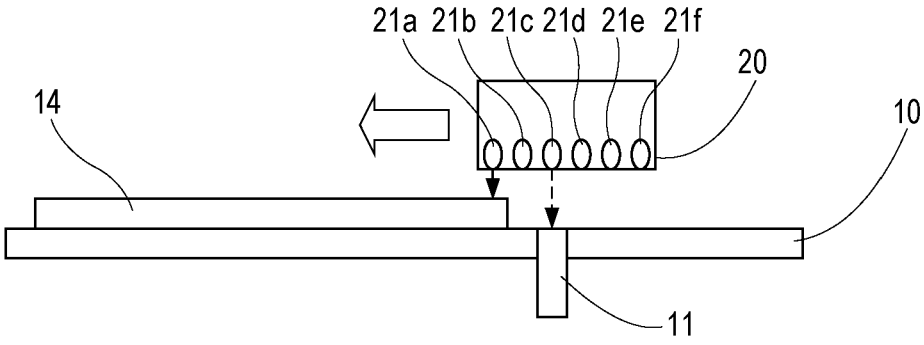
FIG. 5A and FIG. 5B illustrate a situation where preliminary ejection from some of nozzle arrays cannot be performed.
Figure 5B:
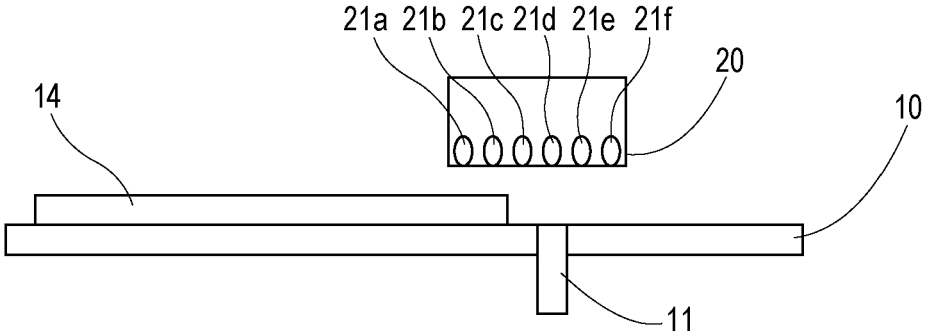

FIG. 5A and FIG. 5B schematically illustrate how the recording head 20 moves when the recording region is set as illustrated in FIG. 4B. The recording region is a narrow area near the end of the sheet 14 adjacent to the home position. In this example, only the nozzle array 21*a* (corresponding to one color, such as black) is used for printing in the recording region, and the other nozzle arrays 21*b* to 21*f* (corresponding to other colors) are not used for printing. Note that this is merely an example, and a determination as to which of the plurality of nozzle arrays 21*a* to 21*f* is or are to be used for printing is made depending on what color is included in an image.

In the state of FIG. 5A, preliminary ejection from the nozzle array 21*c* onto the ink receiver 11 is performed in parallel with printing using the leading nozzle array 21*a*. After the nozzle array 21*a* is moved to the left end of the recording region (i.e., an end of the recording region remote from the home position) and printing in the recording region is completed, the scanning of the recording head 20 is stopped. In the state of FIG. 5B, the scanning is stopped at a position which is a reversing position in the reciprocation. In this state, although preliminary ejection from the nozzle array 21*d* located above the ink receiver 11 is necessary, an encoder signal for the head scanning is not input to the data-transfer/ejection timing generating unit 33. Therefore, it is not possible to perform preliminary ejection from the nozzle array 21*d*. Moreover, since the succeeding nozzle arrays 21*e* and 21*f* are not even able to reach the position above the ink receiver 11, preliminary ejection from the nozzle arrays 21*e* and 21*f* cannot be performed.

The closer the end position of the recording region remote from the home position is to the home position along the platen 10, the more the above-described phenomenon is likely to occur. When the size of the sheet 14 in the sheet width direction (i.e., a region of the platen 10 where the sheet 14 passes through) changes, the probability of occurrence of the above-described phenomenon changes. At the same time, depending on which of the plurality of nozzle arrays 21*a* to 21*f* is or are to be used for recording, the probability of occurrence of the above-described phenomenon changes. The probability of occurrence of the above-described phenomenon also changes depending on the pitch of nozzles used.

As a solution to the problems described above, in the present embodiment, depending on the recording region on the sheet 14 and which of the plurality of nozzle arrays 21*a* to 21*f* is or are to be used for recording, the reversing position at which the recording head 20 is reversed in direction of the reciprocation is determined such that all the plurality of nozzle arrays 21*a* to 21*f* pass over the ink receiver 11 in a single scan included in the reciprocation. The control unit determines the scanning distance of the recording head 20 necessary for preliminary ejection, and also determines the scanning distance of the recording head 20 necessary for printing. Then, on the basis of the larger of the two distances, the control unit sets the moving range of the recording head 20 (i.e., the reversing position in the reciprocation).

Specifically, the control unit determines a distance (first scanning distance) between the farthest of all nozzle arrays used for recording from the ink receiver 11 when the recording head 20 is located at the scanning start position and an end position of the recording region (remote from the ink receiver 11). At the same time, a recording unit determines a distance (second scanning distance) between the farthest of the plurality of nozzle arrays 21*a* to 21*f* from the ink receiver 11 when the recording head 20 is located at the scanning start position and the ink receiver 11. Then, the control unit compares the first scanning distance and the second scanning distance. On the basis of the larger of the two distances, the control unit determines the reversing position in the reciprocation (remote from the home position).

The end position of the recording region (remote from the ink receiver 11) can be determined on the basis of information, such as the size of an image to be printed and the layout of the image on the sheet 14. Such information can be obtained, for example, on the basis of image data, layout information, and the size of the sheet 14 for recording which are stored in memory of the control unit.

The control described above allows all the nozzle arrays 21*a* to 21*f* to pass over the ink receiver 11 in a single scan included in reciprocation. Therefore, preliminary ejection from all the nozzle arrays 21*a* to 21*f* onto the ink receiver 11 can be performed.

Alternatively, the following method may be used. The control unit determines a distance (first distance) between the ink receiver 11 and the end position of the recording region remote from the ink receiver 11. The control unit also determines a distance (second distance) between the closest of the plurality of nozzle arrays 21*a* to 21*f* to the home position and the farthest of all nozzle arrays used for recording from the home position. Then, the control unit compares the first distance and the second distance. If the first distance is smaller than the second distance, the moving distance necessary for recording is increased, and the reversing position is determined such that the closest of the plurality of nozzle arrays 21*a* to 21*f* to the home position moves to the position above the ink receiver 11.

Figure 6:
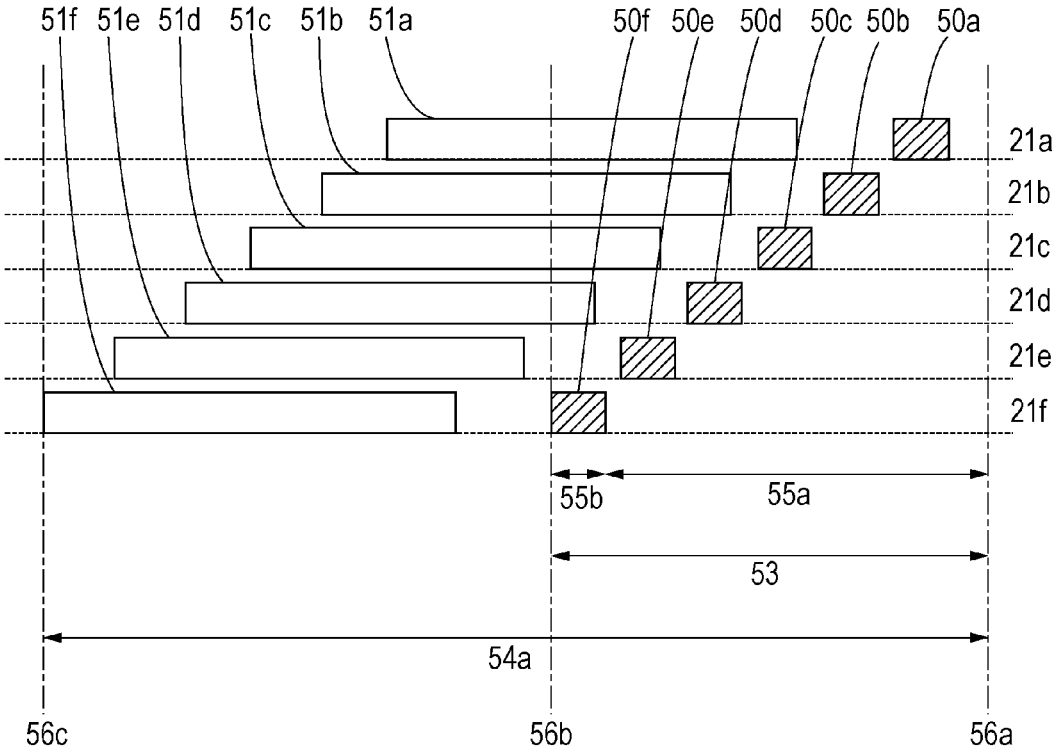
FIG. 6 illustrates how a moving range of a recording head is determined.

FIG. 6 illustrates how a moving range of the recording head 20 (i.e., a reversing position in reciprocation) is determined when printing is performed in a large recording region (see FIG. 4A) and preliminary ejection is performed using all the nozzle arrays 21*a* to 21*f* (see FIG. 3A to FIG. 3D). The horizontal axis in FIG. 6 represents a time scale that runs from right to left.

Reference numeral 56*a* denotes a time at which the recording head 20 starts moving at the scanning start position, and reference numeral 56*c* denotes a time at which the recording head 20 reaches the scanning end position (reversing position). A section 50*a* is a preliminary ejection section representing a time width during which preliminary ejection from the leading nozzle array 21*a* is performed. A section 51*a* is a printing section representing a time width during which printing onto the sheet 14 using the nozzle array 21*a* is performed. Similarly, sections 50*b* to 50*f* are preliminary ejection sections corresponding to the nozzle arrays 21*b* to 21*f*, and sections 51*b* to 51*f* are printing sections corresponding to the nozzle arrays 21*b* to 21*f*. The length between the start time of the section 50*a* (i.e., the right end of the section 50*a*) and the start time of the section 51*a* (i.e., the right end of the section 51*a*) corresponds to the distance between the ink receiver 11 and a right end position (i.e., an upstream position in the scanning direction) of an image region recorded with ink ejected from the nozzle array 21*a*. The time width of the section 51*a* corresponds to an image size, in the scanning direction, of the image region recorded with ink ejected from the nozzle array 21*a*. The same relationship applies to the sections for the other nozzle arrays.

If the recording head 20 scans at least to the position (time 56*b*) at which preliminary ejection from the trailing nozzle array 21*f* in the section 50*f* ends, all the nozzle arrays 21*a* to 21*f* can pass over the ink receiver 11, so that preliminary ejection from all the nozzle arrays 21*a* to 21*f* can be realized. The scanning distance of the recording head 20 necessary for preliminary ejection (corresponding to a period 53) is the sum of a distance (corresponding to a period 55*a*) between the scanning start position (time 56*a*) and the ink receiver 11 at which preliminary ejection from the nozzle array 21*f* starts, and a distance (corresponding to a period 55*b*) for the section 50*f* during which preliminary ejection from the nozzle array 21*f* is performed. Then, when the recording head 20 scans to a position (time 56*c*) at which printing using the trailing nozzle array 21*f* ends, printing of the image region using all the nozzle arrays 21*a* to 21*f* can be completed. The scanning distance of the recording head 20 necessary for printing (corresponding to a period 54*a*) is a distance (period) between the scanning start position (time 56*a*) and the printing end position (time 56*c*) for the nozzle array 21*f*.

The control unit compares the scanning distance of the recording head 20 necessary for preliminary ejection (corresponding to the period 53) with the scanning distance of the recording head 20 necessary for printing (corresponding to the period 54*a*). Then, the control unit performs control such that the recording head 20 scans by a distance corresponding to the larger of the two distances. In the example of FIG. 6, the distance corresponding to the period 54*a* is larger. The control unit sets the moving range of the recording head 20 (i.e., the reversing position in the reciprocation) such that the recording head 20 scans by at least a distance corresponding to the period 54*a*. Thus, preliminary ejection from all the nozzle arrays 21*a* to 21*f* and printing using all the nozzle arrays 21*a* to 21*f* can be performed.

In determining the scanning distance necessary for preliminary ejection and the scanning distance necessary for printing, it is preferable to take into account a margin for acceleration or deceleration, and for positional adjustment of each nozzle array. By adding such a margin, it is possible to reliably input an encoder signal necessary for printing and preliminary ejection to the data-transfer/ejection timing generating unit 33, and thus to improve reliability of printing and preliminary ejection.

Figure 7:
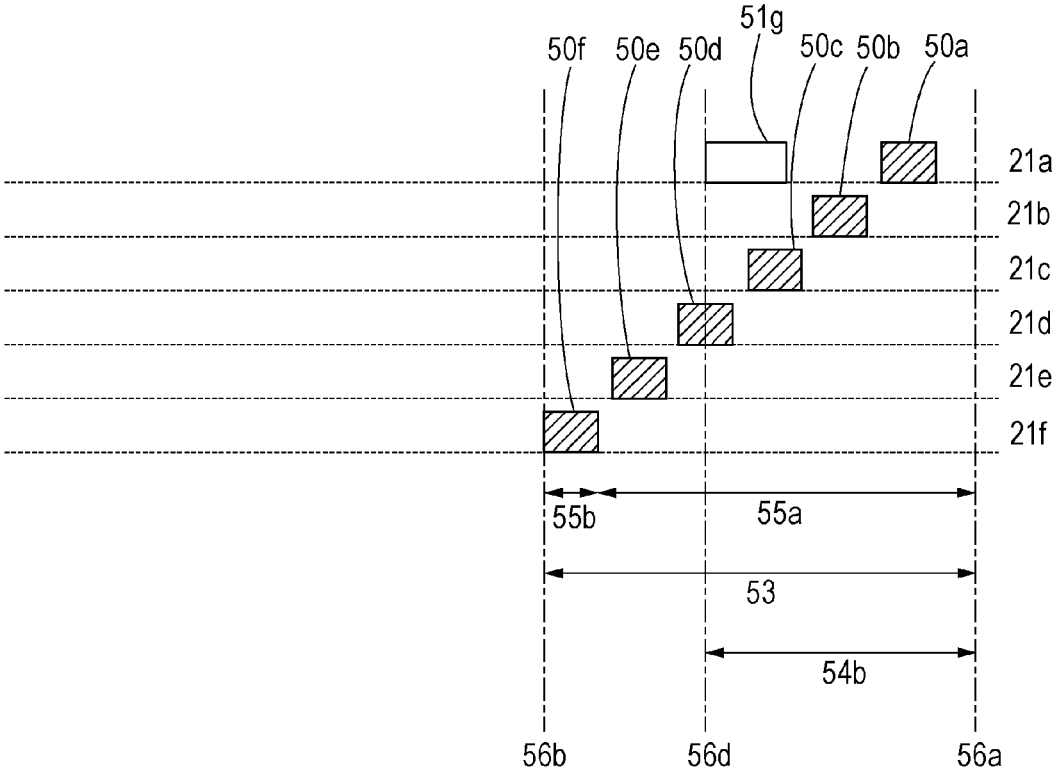
FIG. 7 also illustrates how a moving range of the recording head is determined.

FIG. 7 illustrates an example in which a recording region is a narrow region close to an end of the sheet 14 (see FIG. 4B). In this example, only the nozzle array 21*a* is used for recording, and the other nozzle arrays 21*b* to 21*f* are not used (see FIG. 5A and FIG. 5B). As in the case of FIG. 6, the horizontal axis in FIG. 7 represents a time scale that runs from right to left. The scanning distance (corresponding to the period 53) of the recording head 20 necessary for preliminary ejection can be determined in the same manner as in the case of FIG. 6.

However, in FIG. 7, a section during which printing is performed is only a printing section 51*g* for the nozzle array 21*a* used for printing. The scanning distance of the recording head 20 necessary for printing (corresponding to a period 54*b*) is a distance (period) between the scanning start position (time 56*a*) and the printing end position (time 56*d*) for the nozzle array 21*a*.

The control unit compares the scanning distance of the recording head 20 necessary for preliminary ejection and the scanning distance of the recording head 20 necessary for printing. In the example of FIG. 7, the former scanning distance is larger than the latter, in contrast to the case of FIG. 6. The control unit sets the moving range of the recording head 20 (i.e., the reversing position in the reciprocation) such that the recording head 20 scans by at least a distance corresponding to the period 53. Thus, all the nozzle arrays 21*a* to 21*f* can pass over the ink receiver 11, so that preliminary ejection from all the nozzle arrays 21*a* to 21*f* can be realized. At the same time, printing onto an end portion of the sheet 14 using the nozzle array 21*a* can be completed.

Figure 8A:
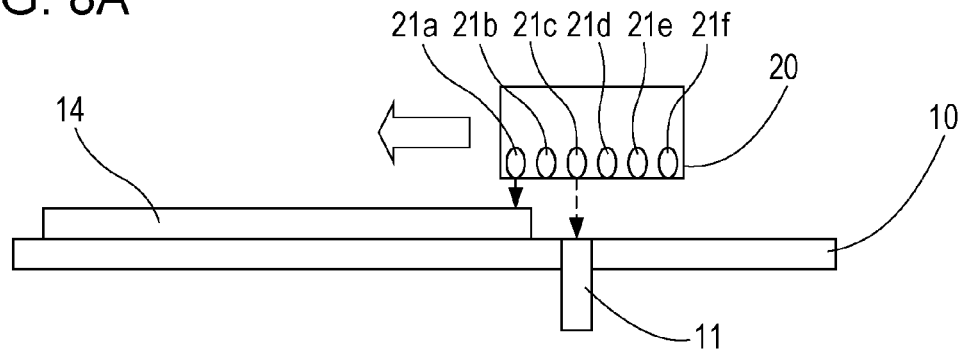
FIG. 8A to FIG. 8C illustrate preliminary ejection onto the ink receiver.
Figure 8B:
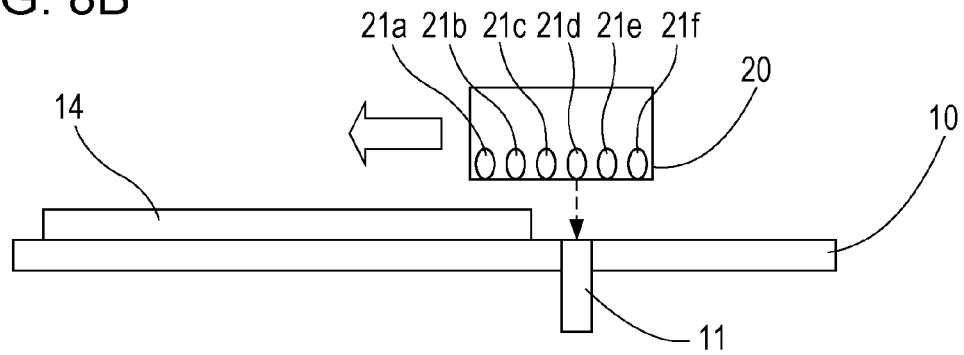
Figure 8C:
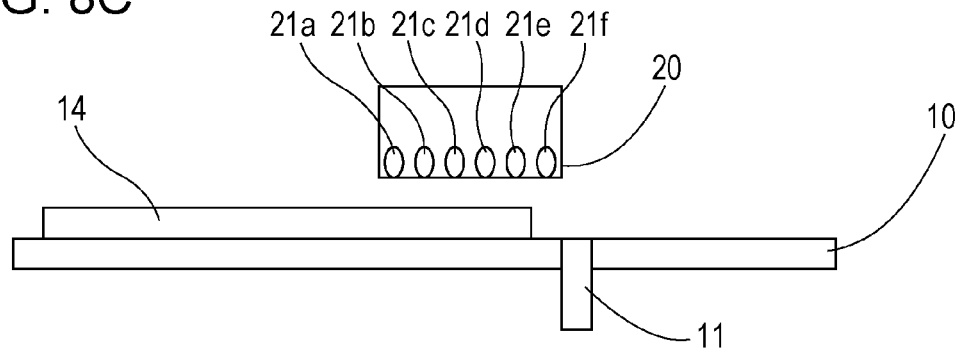

FIG. 8A to FIG. 8C schematically illustrate an operation controlled by the method of FIG. 7. In the state of FIG. 8A, as in the case of FIG. 5A, preliminary ejection from the nozzle array 21*c* onto the ink receiver 11 is performed in parallel with printing using the nozzle array 21*a*. Then, unlike in the case of FIG. 5B, the recording head 20 continues to move even after completion of printing using the nozzle array 21*a*. In the state of FIG. 8B, preliminary ejection from the nozzle array 21*d* can be performed. While the recording head 20 is being moved to the position illustrated in FIG. 8C, preliminary ejection is performed every time each nozzle array passes over the ink receiver 11. The position illustrated in FIG. 8C is a reversing position at which the moving direction of the recording head 20 is reversed. After a single band of sub-scanning, the recording head 20 returns to the scanning start position. In this return path, recording and preliminary ejection from each nozzle array may be performed. In the same manner, the reciprocation is repeated to form an image in a recording region.

It is possible that different types of recording regions, such as those illustrated in FIG. 4A and FIG. 4B, are present in the same sheet 14. In such a case, the moving range of the recording head 20 (i.e., the reversing position in the reciprocation) may be changed depending on the location in the sheet 14.

In the example described above, preliminary ejection is performed in each reciprocation of the recording head 20. However, preliminary ejection may not necessarily have to be performed each time. For example, preliminary ejection may be performed once in a predetermined number of scans, depending on the accumulated printing time or the number of scans of the recording head 20.

Figure 9:
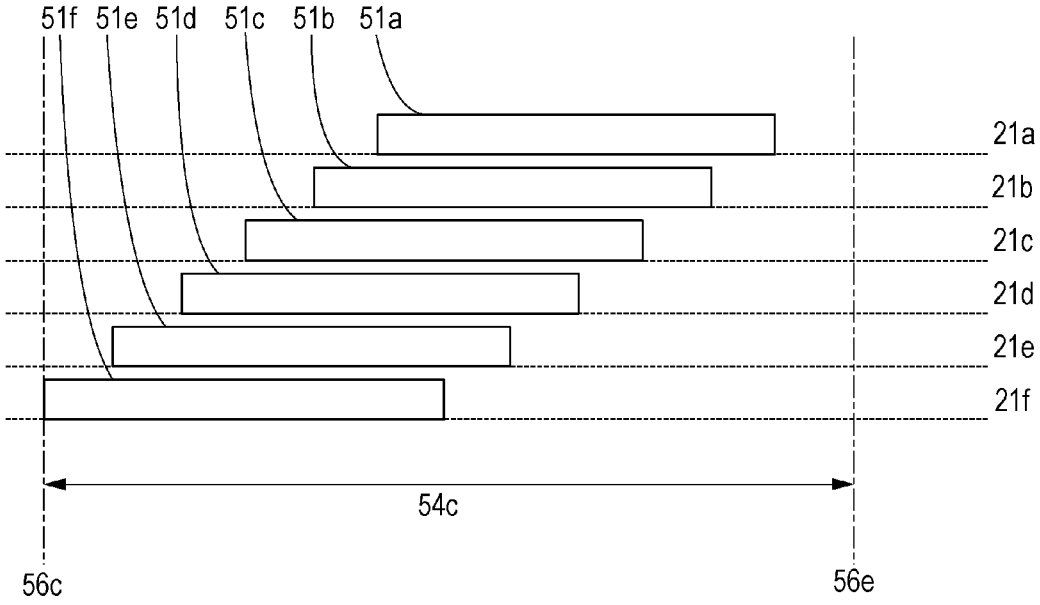
FIG. 9 illustrates how a moving range of the recording head is determined.

FIG. 9 illustrates how a moving range of the recording head 20 is determined when recording is performed without preliminary ejection. The scanning distance of the recording head 20 necessary for printing (corresponding to a period 54*c*) is a distance between the scanning start position (time 56*e*) and the printing end position (time 56*c*) for the nozzle array 21*f*. The control unit sets the moving range of the recording head 20 (i.e., the reversing position in the reciprocation) such that the recording head 20 scans by at least a distance corresponding to the period 54*c*.

Since preliminary ejection is not performed in this case, the scanning start position (time 56*e*) of the recording head 20 can be brought closer to the printing section 51*a* for the nozzle array 21*a* than the scanning start position corresponding to the time 56*a* (see FIG. 6) is to the printing section 51*a*. It is thus possible to reduce the scanning distance of the recording head 20 and improve printing throughput. If recording is performed in a narrow recording region, such as that illustrated in FIG. 4B, without preliminary ejection, it is not necessary to take into account the scanning distance of the recording head 20 necessary for preliminary ejection in FIG. 7. In this case, the scanning distance can be as small as that corresponding to the period 54*b*.

Figure 10:
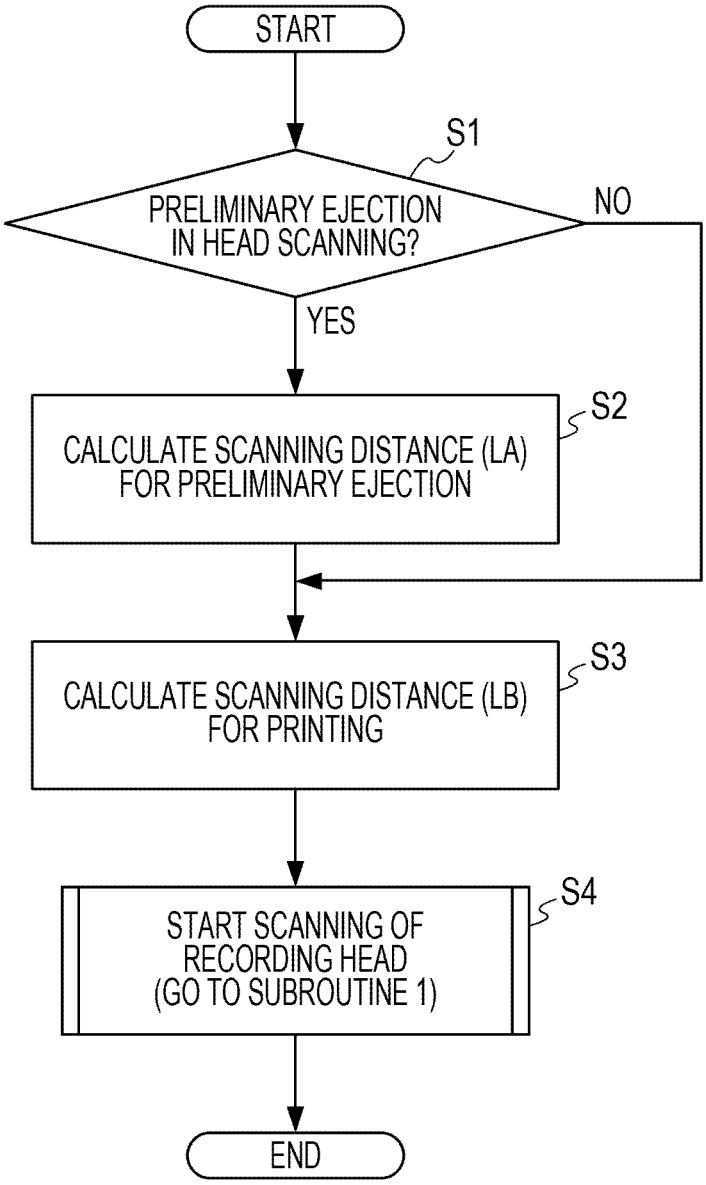
FIG. 10 is a flowchart illustrating a procedure of how movement of the recording head is controlled.
Figure 11:
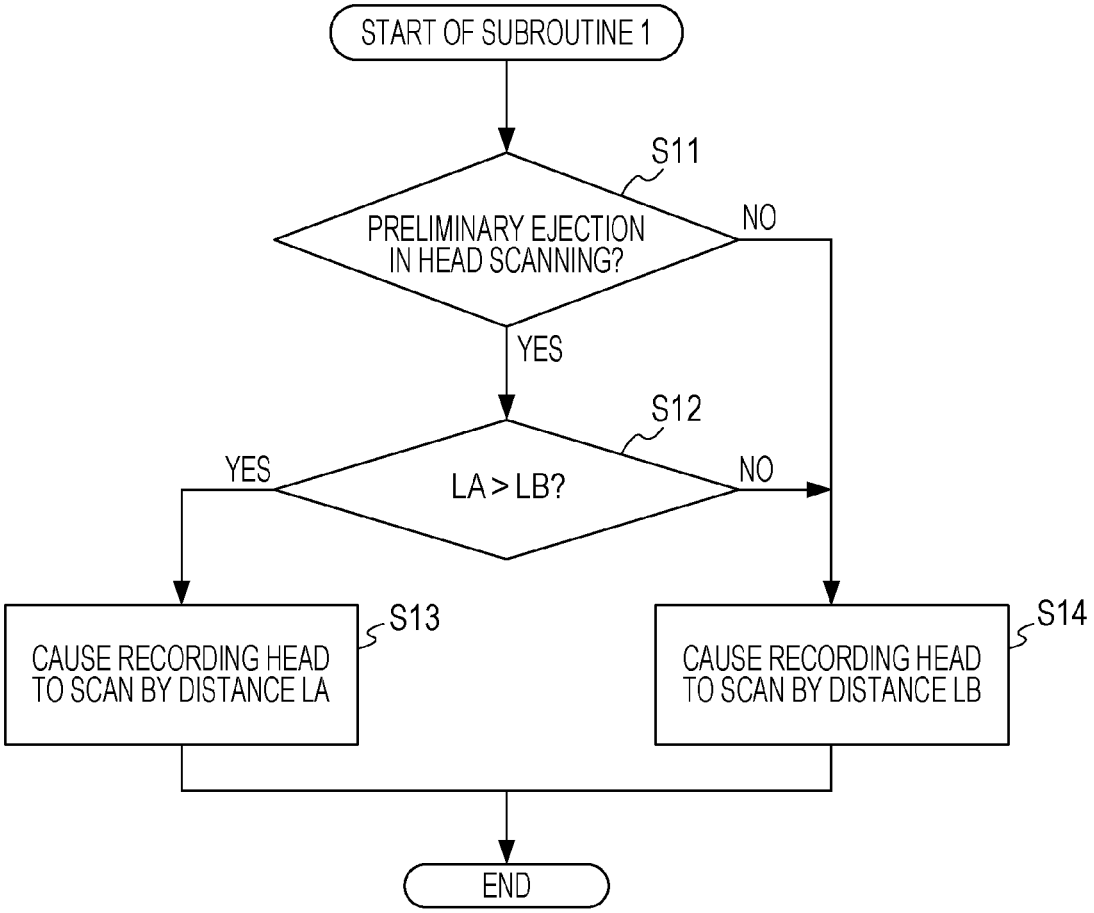
FIG. 11 is a flowchart illustrating a detailed procedure of one of steps in the flowchart of FIG. 10.

FIG. 10 and FIG. 11 are flowcharts illustrating a sequence of movement control performed in the procedure described above. In step S1 of FIG. 10, a determination is made as to whether preliminary ejection is to be performed in scanning of the recording head 20. If preliminary ejection is to be performed (YES in step S1), the process proceeds to step S2. In step S2, a scanning distance LA of the recording head 20 necessary for preliminary ejection is calculated by the method described above. If preliminary ejection is not to be performed (NO in step S1), the process bypasses step S2 and proceeds to step S3. In step S3, a scanning distance LA of the recording head 20 necessary for printing is calculated by the method described above. Then the process proceeds to step S4, where the scanning distance of the recording head 20 is determined and the scanning starts.

FIG. 11 is a flowchart for a subroutine 1 representing a detailed procedure of step S4. In step S11, a determination is made as to whether preliminary ejection is to be performed in the scanning of the recording head 20. If preliminary ejection is to be performed (YES in step S11), the process proceeds to step S12. In step S12, a comparison between LA and LB is made. If LA is larger than LB (YES in step S12), the process proceeds to step S13. In step S13, the scanning distance is set to LA, on the basis of which scanning of the recording head 20 is performed. On the other hand, if LA is smaller than or equal to LB (NO in step S12), the process proceeds to step S14. In step S14, the scanning distance is set to LB, on the basis of which scanning of the recording head 20 is performed. If it is determined in step S11 that preliminary ejection is not to be performed (NO in step S11), the process proceeds to step S14, where the scanning distance is set to LB, on the basis of which scanning is performed.

The calculation of the scanning distance LA can be done in a short time if only one or a few of nozzle arrays for preliminary ejection are used as representatives. For example, the positional information of the nozzle array 21*f* closest to the home position is used in calculation. Similarly, the calculation of the scanning distance LB can be done in a short time if only one or a few of nozzle arrays used for printing are used as representatives. For example, the positional information of a nozzle array closest to the home position of all nozzle arrays used for printing is used in calculation. When a plurality of nozzle arrays are used, information about the distance between nozzle arrays is also used in calculation. In the calculation of the scanning distances LA and LB, it is possible to reflect information about the distance between the ink receiver 11 and a position of the sheet 14 on the platen 10, the position being determined by the size of the sheet 14 in the sheet width direction. The range of recording on the sheet 14 may vary depending on the ink color to be used. Therefore, in accordance with image data, a different range of recording may be set for each ink color (nozzle array) used in image formation, so that the scanning distance LB can be determined.

The description above is merely an example, and the number of nozzle arrays included in the recording head 20 is not limited to that described above. A determination as to which of the plurality of nozzle arrays is or are to be used for printing is made depending on what color is included in the image.

The number of ink receivers 11 is not limited to one, and more than one ink receivers 11 may be provided depending on the sheet width. The ink receivers 11 may be provided on both sides of the sheet 14. If scanning of the recording head 20 which involves preliminary ejection is to be continuously performed, the scanning distance determined by the method described above may be increased before start of scanning or during scanning. When the scanning distance is increased, preliminary ejection onto the ink receiver 11 on the opposite side of the sheet 14 can be performed in the next scan.

The same applies to the case where preliminary ejection onto ink receivers both close to and away from the sheet 14 is performed in combination with printing. If preliminary ejection is performed onto an ink receiver away from the sheet 14, it may be determined, in step S1 of FIG. 10 and step S11 of FIG. 11, that preliminary ejection is not to be performed.

In the embodiment described above, regardless of the recording region on the sheet 14 and which of the plurality of nozzle arrays is or are to be used for recording, preliminary ejection from all the nozzle arrays can be reliably performed in the reciprocation of the recording head 20 for recording. It is thus possible to effectively suppress degradation in image quality and significantly improve printing throughput.

When recording and preliminary ejection are performed in parallel as described above, the distance between the sheet end and the ink receiver 11 is very small. Therefore, when the leading nozzle array in one scan is located above the ink receiver 11, the trailing nozzle array is away from the sheet end by substantially the distance between the leading and trailing nozzle arrays. On the other hand, when recording and preliminary ejection are not performed in parallel, even when the trailing nozzle array in one scan is located above the ink receiver 11, the leading nozzle array has not yet reached the printing region and printing cannot be performed. In this case, the distance between the sheet end and the ink receiver 11 is larger than (e.g., twice) the distance between the leading and trailing nozzle arrays. This means that the stroke of the reciprocation of the recording head 20 is increased.

For example, assume that the distance between the leading and trailing nozzle arrays is 1.6 inches, a Japanese Industrial Standards (JIS) A4 size sheet (with a width of 8.3 inches) is used, and preliminary ejection is performed at both ends of the sheet. The moving distance of the recording head 20 in one scan in reciprocation can be approximately calculated as follows.

Recording and preliminary ejection are performed in parallel: $8.3+1.6\times2=11.5$ (in inches)

Recording and preliminary ejection are not performed in parallel: $8.3+1.6\times2\times2=14.7$ (in inches)

Thus, in the present embodiment, the scanning distance of the recording head 20 is reduced by about 22%, which means that printing throughput can be improved accordingly. In the present embodiment, even when the scanning distance is increased such that preliminary ejection from all the nozzle arrays can be performed even in the case where the recording region is narrow, the increase and the resulting degradation in printing throughput are negligible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-183046 filed Aug. 18, 2010 and No. 2011-150904 filed Jul. 7, 2011, which are hereby incorporated by reference herein in their entirety.

What is claimed is:

1. An inkjet recording apparatus comprising:

a recording unit configured to record an image on a sheet in a recording region by causing a recording head including a plurality of nozzle arrays to reciprocate over a recording distance along a surface of the sheet in a direction in which the plurality of nozzle arrays is arranged;

an ink receiver configured to receive ink ejected outside the sheet in preliminary ejection from a nozzle array that has reached the ink receiver, wherein an ink receiving portion of the ink receiver has a size that is less than a size of the plurality of nozzle arrays; and a control unit configured to control the recording unit to reciprocate the recording head and to determine a reversing position at which the recording head is reversed in the reciprocation based on a recording distance of the recording region and on which of the plurality of nozzle arrays is or are to be used for recording, wherein, in a case where a last nozzle array to be used for recording will reach an end of the recording distance at a time when a trailing nozzle array reaches the ink receiver, the control unit determines the reversing position of the reciprocation such that (i) the trailing nozzle array and any nozzle arrays behind the trailing nozzle array pass over and eject onto the ink receiver in a single scan and (ii) a distance of the reciprocation beyond the recording distance is a minimum distance, wherein the plurality of nozzle arrays includes a second nozzle array positioned between a first nozzle array and a third nozzle array and the control unit controls so that the first nozzle array ejects onto the sheet and the third nozzle array ejects onto the ink receiver while the second nozzle array is prevented from ejecting.

2. The inkjet recording apparatus according to claim 1, wherein the control unit determines the reversing position depending on where an end position of the recording region remote from the ink receiver is located in the direction in which the plurality of nozzle arrays are arranged, and on which of the plurality of nozzle arrays is or are to be used for recording.

3. The inkjet recording apparatus according to claim 2, wherein the control unit determines the reversing position based on a larger of a first scanning distance and a second scanning distance, wherein the first scanning distance is a distance between a farthest one of the plurality of nozzle arrays used for recording remote from the ink receiver when the recording head is located at a scanning start position and the end position of the recording region, wherein the second scanning distance is a distance between a farthest one of the plurality of nozzle arrays remote from the ink receiver when the recording head is located at the scanning start position and the ink receiver.

4. The inkjet recording apparatus according to claim 2, wherein, in a case where, in the direction in which the plurality of nozzle arrays are arranged, a first distance between the ink receiver and the end position of the recording region remote from the ink receiver is smaller than a second distance between a closest of the plurality of nozzle arrays to a home position and a farthest of all nozzle arrays used for recording from the home position, the control unit determines the reversing position such that a nozzle array closest to the home position is moved to a position above the ink receiver.

5. The inkjet recording apparatus according to claim 1, wherein recording onto the sheet using a first nozzle array from the plurality of nozzle arrays can be performed in parallel with preliminary ejection from a second nozzle array from the plurality of nozzle arrays.

6. The inkjet recording apparatus according to claim 5, wherein the control unit determines the reversing position based on whether the preliminary ejection is to be performed in the single scan.

7. The inkjet recording apparatus according to claim 1, further comprising: a platen disposed in a region which includes a region where the recording head reciprocates, wherein the platen is provided with the ink receiver.

8. An inkjet recording method for an inkjet recording apparatus having an ink receiver configured to receive ink ejected outside a sheet in preliminary ejection from a nozzle array that has reached the ink receiver, wherein an ink receiving portion of the ink receiver has a size that is less than a size of a plurality of nozzle arrays, the inkjet recording method comprising:

recording an image on the sheet in a recording region by causing a recording head including the plurality of nozzle arrays to reciprocate over a recording distance along a surface of the sheet in a direction in which the plurality of nozzle arrays is arranged; and controlling to reciprocate the recording head and to determine a reversing position at which the recording head is reversed in the reciprocation based on a recording distance of the recording region and on which of the plurality of nozzle arrays is or are to be used for recording, wherein, in a case where a last nozzle array to be used for recording will reach an end of the recording distance at a time when a trailing nozzle array reaches the ink receiver, controlling includes determining the reversing position of the reciprocation such that (i) the trailing nozzle array and any nozzle arrays behind the trailing nozzle array pass over and eject onto the ink receiver in a single scan and (ii) a distance of the reciprocation beyond the recording distance is a minimum distance, wherein the plurality of nozzle arrays includes a second nozzle array positioned between a first nozzle array and a third nozzle array and controlling includes controlling so that the first nozzle array ejects onto the sheet and the third nozzle array ejects onto the ink receiver while the second nozzle array is prevented from ejecting.

* * * * *